US009856827B2

(12) United States Patent
Xue

(10) Patent No.: US 9,856,827 B2
(45) Date of Patent: Jan. 2, 2018

(54) ANTI-ADJUSTING ROTARY VALVE TYPE CARBURETOR

(71) Applicant: Meiying Xue, Hangzhou (CN)

(72) Inventor: Meiying Xue, Hangzhou (CN)

( * ) Notice: Subject to any disclaimer, the term of this patent is extended or adjusted under 35 U.S.C. 154(b) by 104 days.

(21) Appl. No.: 14/991,070

(22) Filed: Jan. 8, 2016

(65) Prior Publication Data

US 2017/0122262 A1 May 4, 2017

(30) Foreign Application Priority Data

Nov. 2, 2015 (CN) ..... 2015 2 0864035 U

(51) Int. Cl.

| | |
|---|---|
| ***F02M 19/04*** | (2006.01) |
| ***F02M 7/06*** | (2006.01) |
| ***F02M 9/08*** | (2006.01) |
| ***F02M 3/10*** | (2006.01) |

(52) U.S. Cl.

CPC ..... *F02M 3/10* (2013.01); *F02M 7/06* (2013.01); *F02M 9/08* (2013.01); *F02M 19/04* (2013.01)

(58) Field of Classification Search

CPC ... B01F 3/04; F02M 7/06; F02M 3/10; F02M 9/08; F02M 19/04

USPC ..... 261/35, 44.6, 44.8, 69.1, DIG. 38

See application file for complete search history.

(56) References Cited

U.S. PATENT DOCUMENTS

| | | | | |
|---|---|---|---|---|
| 5,709,822 | A | 1/1998 | Togashi | |
| 6,394,424 | B2 | 5/2002 | Pattullo et al. | |
| 6,827,337 | B2 | 12/2004 | Terakado | |
| 7,290,757 | B2 * | 11/2007 | Horikawa ..... | F02M 9/08 261/44.6 |
| 8,608,136 | B2 | 12/2013 | Saito | |
| 8,608,137 | B2 | 12/2013 | Suzuki | |
| 2014/0264964 | A1 | 9/2014 | Chen | |

FOREIGN PATENT DOCUMENTS

JP 2007077812 A 3/2007

* cited by examiner

*Primary Examiner* — Robert A Hopkins
(74) *Attorney, Agent, or Firm* — Caesar Rivise, PC

(57) ABSTRACT

An anti-adjusting rotary valve type carburetor includes a high speed adjustment oil needle having an eccentric hole and an idle adjustment oil needle having an eccentric hole. Also disclosed is a specialized adjustment tool having an eccentric convex platform for adjusting the high speed adjustment oil needle and the idle adjustment oil needle. Also disclosed is a high speed adjustment oil needle having an eccentric convex platform and an idle speed adjustment oil needle having an eccentric convex platform. Also disclosed is a specialized adjustment tool having an eccentric hole for adjusting the high speed adjustment oil needle and the idle speed adjustment oil needle.

25 Claims, 14 Drawing Sheets

ANTI-ADJUSTING ROTARY VALVE TYPE CARBURETOR

FIELD OF THE INVENTION

This invention relates to carburetors and more particularly to anti-adjusting rotary valve type carburetors.

BACKGROUND OF THE INVENTION

The carburetor is vacuum produced in the engine work; the gasoline can be mixed with air for a certain proportion. The carburetor, as a precision device, plays an important role in the engine and can be called "the heart of the engine". The device should include a starting device, idle device, and throttle control device. According to the requirements of the different work state for the engine, the carburetor automatically matches the corresponding mixed gas concentration, puts out the corresponding amount of mixed gas, in order to make the distribution of the mixed gas mixed evenly, and the carburetor has the effect of fuel atomization, for the normal operation of the machine.

In order to make the carburetor always work stably in the optimum mixture ratio of the fuel and air, usually carburetor manufacturers in the carburetor factory have the carburetor fuel and air mixing ratio adjusted to the optimal state, which can not only play the best working performance of the engine, and significantly extend the carburetor normal working life, but also make the carburetor reach optimal oil state at work, thus greatly saving fuel resources. In order to enable the carburetor to be stable in the optimum mixture ratio of the fuel and air, and play the optimal performance of engine, and also to substantially extend the carburetor normal service life and save fuel resources, it is necessary to set up an anti-adjusting mechanism on the carburetor to prevent non-specialized users from randomly adjusting the fuel and air mixing proportion of the carburetor. However, existing carburetors cannot meet the above requirements. For example, U.S. Pat. No. 6,394,424 discloses a rotary valve carburetor, including: the structure of the regulating head of the idle adjustment oil needle is linear type, and a steel ball is pressed on the top of the regulation structure; this anti-adjusting structure is very complex, economic performance is very poor, and engine manufacturers or carburetor manufacturers will not be able to adjust the idle oil needle when they need to adjust the carburetor technical parameters.

SUMMARY OF THE INVENTION

In order to solve the technical defects of existing carburetors, the invention has the technical proposal adopted as following:

An anti-adjusting rotary valve type carburetor, comprising a body, the body is provided with a high speed adjustment oil needle mounting hole, a high speed adjustment oil needle having an eccentric hole is installed inside the high speed adjustment oil needle mounting hole of the body, the high speed adjustment oil needle having the eccentric hole comprising a head of the high speed adjustment oil needle having the eccentric hole, the end face of the head of the high speed adjustment oil needle is provided with a first eccentric hole.

An anti-adjusting rotary valve type carburetor, comprising a body, the body is provided with a rotary valve hole, a rotary valve is installed inside the rotary valve hole, a main needle sleeve is installed on the top of the rotary valve, the main needle sleeve is provided with an idle adjustment oil needle mounting hole, an idle adjustment oil needle having an eccentric hole is installed inside the idle adjustment oil needle mounting hole of the main needle sleeve, the idle adjustment oil needle having the eccentric hole comprising a head of the idle adjustment oil needle having the eccentric hole, the end face of the head of the idle adjustment oil needle is provided with a second eccentric hole.

A specialized adjustment tool having an eccentric convex platform, comprising a handle and a head, the front face of the head is provided with the concentric counterbore, the bottom surface of the concentric counterbore is provided with an eccentric convex platform.

An anti-adjusting rotary valve type carburetor, comprising a body, the body is provided with a high speed adjustment oil needle mounting hole, a high speed adjustment oil needle having an eccentric convex platform is installed inside the high speed adjustment oil needle mounting hole of the body, the high speed adjustment oil needle having the eccentric convex platform comprising a head of the high speed adjustment oil needle having the eccentric convex platform, the head of the high speed adjustment oil needle is provided with a first eccentric convex platform.

An anti-adjusting rotary valve type carburetor, comprising a body, the body is provided with a rotary valve hole, a rotary valve is installed inside the rotary valve hole, a main needle sleeve is installed on the top of the rotary valve, the main needle sleeve is provided with an idle adjustment oil needle mounting hole, an idle adjustment oil needle having an eccentric convex platform is installed inside the idle adjustment oil needle mounting hole of the main needle sleeve, the idle adjustment oil needle having the eccentric convex platform comprising a head of the idle adjustment oil needle, the head of the idle adjustment oil needle is provided with a second eccentric convex platform.

A specialized adjustment tool having an eccentric hole, comprising a handle and a head, the front face of the head is provided with the concentric blind hole, the bottom surface of the concentric blind hole is provided with an eccentric counterbore.

Preferably, the body is provided with an air intake passage, an air and fuel mixing passage and an outlet of the air and fuel mixing passage.

In any of the above schemes, preferably, the front end of the mounting hole for the high speed adjustment oil needle is provided with a recess of the body.

In any of the above schemes, preferably, the front end of the mounting hole for the idle adjustment oil needle is provided with a recess of the main needle sleeve.

In any of the above schemes, preferably, a pump cover is installed on the lower part of the body, the fuel pump diaphragm is installed between the fitting surface of the body and the fitting surface of the pump cover.

In any of the above schemes, preferably, the lower end face of the body is provided with a recess, a pressure pulse chamber is formed by a cavity enclosed by the recess and the fuel pump diaphragm, the body is also provided with a pressure pulse passage, the pressure pulse passage is communicated with the pressure pulse chamber.

In any of the above schemes, preferably, the mounting hole for the high speed adjustment oil needle extends from a recess of the body toward inside of the body and it is also successively provided with a first internal thread of the body, a seal sleeve mounting hole for the high speed adjustment oil needle, an oil passage cavity for the high speed adjustment oil needle and a outlet of the oil passage hole for the high speed adjustment oil needle.

In any of the above schemes, preferably, the body is provided with a fuel inlet, the fuel inlet is communicated with the outlet of the oil passage hole for the high speed adjustment oil needle.

In any of the above schemes, preferably, the high speed adjustment oil needle having an eccentric hole extends from the side of the head of the high speed adjustment oil needle having the eccentric hole and it is also successively provided with a locking portion of the high speed adjustment oil needle, threaded portion of the high speed adjustment oil needle, a first light bar portion of the high speed adjustment oil needle, and a tip portion of the high speed adjustment oil needle.

In any of the above schemes, preferably, the shape of the tip portion of the high speed adjustment oil needle is conical.

In any of the above schemes, preferably, a seal sleeve for the high speed adjustment oil needle is installed inside the seal sleeve mounting hole for the high speed adjustment oil needle.

In any of the above schemes, preferably, the seal sleeve for the high speed adjustment oil needle is provided with a first light bar portion of the seal sleeve and a first inner hole.

In any of the above schemes, preferably, the main needle sleeve is provided inside with an internal threaded portion of the main needle sleeve and light bar portion of the main needle sleeve, an anti-loosing seal sleeve for the idle adjustment oil needle is installed inside the light bar portion of the main needle sleeve.

In any of the above schemes, preferably, the anti-loosing seal sleeve for the idle adjustment oil needle is provided with a second light bar portion of the seal sleeve and a second inner hole.

In any of the above schemes, preferably, the head of the idle adjustment oil needle having an eccentric hole is provided with a threaded portion of the idle adjustment oil needle having the eccentric hole.

In any of the above schemes, preferably, the head of the idle adjustment oil needle having an eccentric hole that is relative to a second eccentric hole is provided with the concentric blind hole.

In any of the above schemes, preferably, the head of the specialized adjustment tool having an eccentric convex platform is provided with a light bar portion.

In any of the above schemes, preferably, the high speed adjustment oil needle having an eccentric convex platform extends from the side of the head of the high speed adjustment oil needle having the eccentric convex platform and it is also successively provided with a locking portion of the high speed adjustment oil needle, threaded portion of the high speed adjustment oil needle, a first light bar portion of the high speed adjustment oil needle, and a tip portion of the high speed adjustment oil needle.

In any of the above schemes, preferably, the shape of the tip portion of the high speed adjustment oil needle is conical.

In any of the above schemes, preferably, the head of the specialized adjustment tool having an eccentric hole is provided with a light bar portion.

Comparing with the prior art, the invention has the beneficial effects as follows: on the one hand, the high speed adjustment oil needle having an eccentric hole and the idle adjustment oil needle having an eccentric hole are all provided with a threaded portion, the head of the high speed adjustment oil needle and the head of the idle adjustment oil needle are all provided with an eccentric hole. We must use the specialized adjustment tool having an eccentric convex platform to adjust the high speed adjustment oil needle having an eccentric hole and the idle adjustment oil needle having an eccentric hole when we need. When adjusted, the adjusting oil needle can move along the axis of the threaded portion, for regulating the flow of oil into the carburetor. Because clients usually have no specialized adjustment tool having an eccentric convex platform, so they can not be adjusted freely into the carburetor oil flow, thus ensures that the engine is always in an optimal set state, and to ensure that the exhaust gas discharged by the engine to meet the requirements of environmental protection. On the other hand, the high speed adjustment oil needle having an eccentric convex platform and the idle adjustment oil needle having an eccentric convex platform are all provided with a threaded portion, and the head of the high speed adjustment oil needle and the head of the idle adjustment oil needle are all provided with an eccentric convex platform, thus we must use the specialized adjustment tool having an eccentric hole to adjust the high speed adjustment oil needle having an eccentric convex platform and the idle adjustment oil needle having an eccentric convex platform. When adjusted, the adjusting oil needle can move along the axis of the threaded portion, for regulating the flow of oil into the carburetor. Similarly, because customers usually have no specialized adjustment tool having an eccentric hole, so they cannot be adjusted freely flow to the carburetor oil so as to ensure the engine is always in an optimal set state, and to ensure that the exhaust gas discharged by the engine to meet the requirements of environmental protection.

Figure 1:
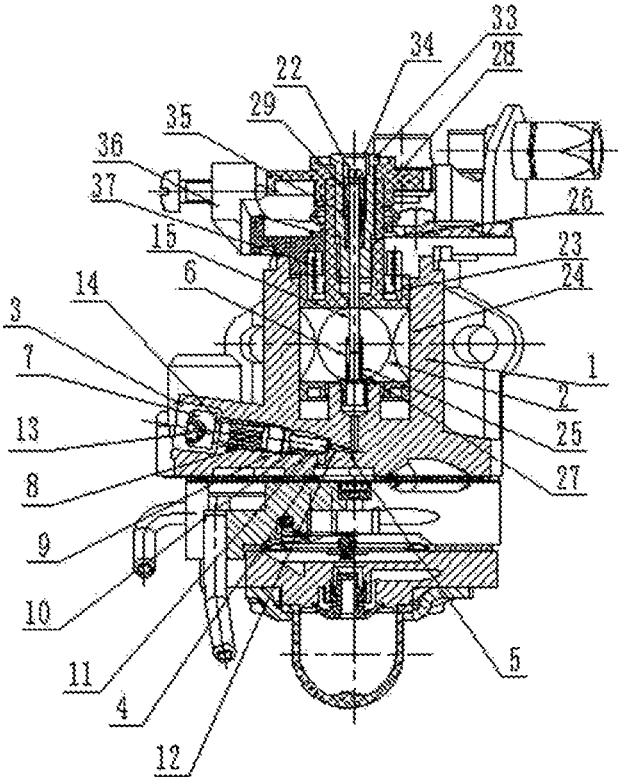
FIG. 1 is an A-A section view of an optimal embodiment in accordance with the present invention, in which the adjustment oil needle is a high speed adjustment oil needle with an eccentric hole and an idle adjustment oil needle with an eccentric hole.
Figure 2:
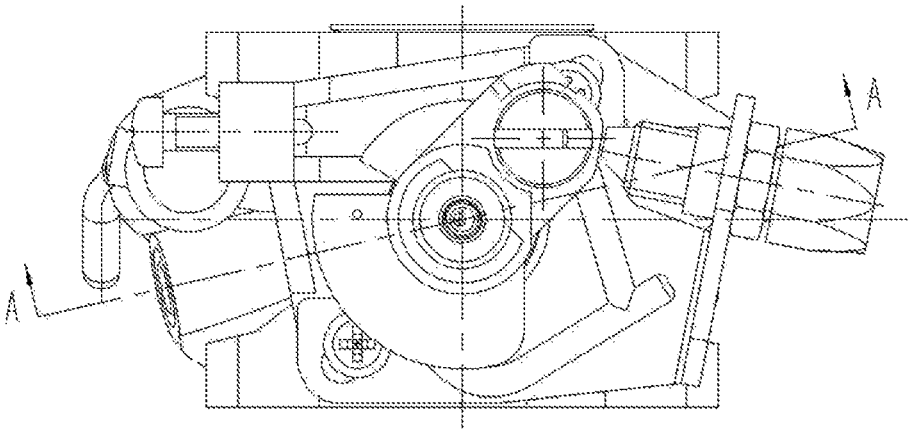
FIG. 2 is a plan view of the embodiment of FIG. 1 in accordance with the invention.
Figure 3:
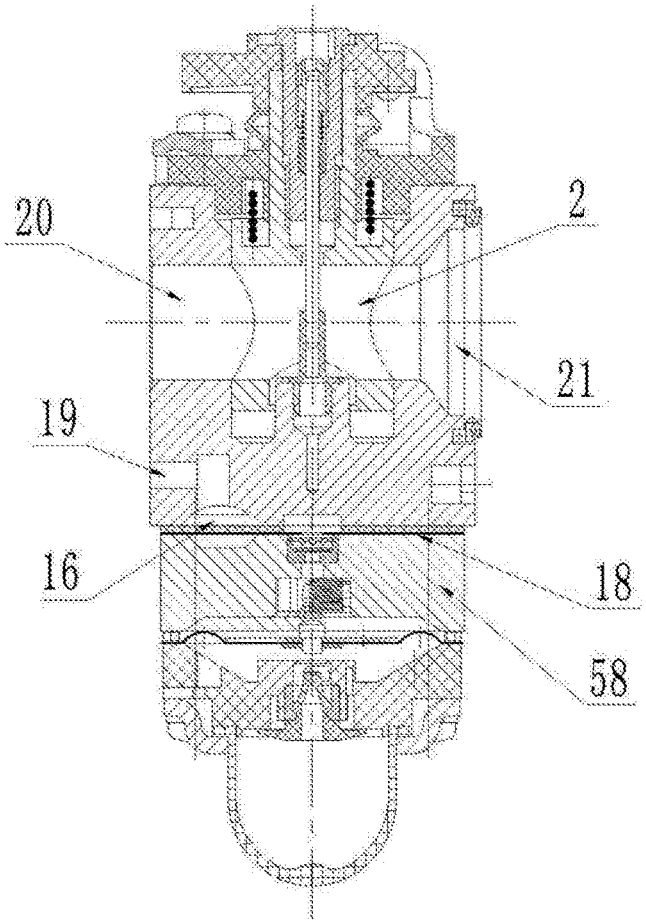
FIG. 3 is a section view of the embodiment of FIG. 1 in accordance with the invention and having a rotary valve shown in its wide-open position.

1 the body; 2 the air and fuel mixing passage; 3 the recess of the body; 4 the fuel inlet; 5 the outlet of the oil passage hole for the high speed adjustment oil needle; 6 the outlet for oil; 7 the head of the high speed adjustment oil needle having an eccentric hole; 8 the locking portion of the high speed adjustment oil needle; 9 the threaded portion of the high speed adjustment oil needle; 10 a first light bar portion of the high speed adjustment oil needle; 11 the seal sleeve for the high speed adjustment oil needle; 12 the tip portion of the high speed adjustment oil needle; 13 a first eccentric hole; 14 the high speed adjustment oil needle having an eccentric hole; 15 the idle adjustment oil needle having an eccentric hole; 16 the pressure pulse chamber; 17 the internal threaded portion of the main needle sleeve; 18 the fuel pump diaphragm; 19 the pressure pulse passage; 20 the outlet of the air and fuel mixing passage; 21 the air intake passage; 22 a second eccentric hole; 23 the rotary valve; 24 the rotary valve hole; 25 the main nozzle; 26 the anti-loosing seal sleeve for the idle adjustment oil needle; 27 the hole of the main nozzle; 28 the rotary plate; 29 the head of the idle adjustment oil needle having eccentric hole; 30 a first internal threaded portion of the body; 31 the seal sleeve mounting hole for the high speed adjustment oil needle; 32 the oil passage cavity for the high speed adjustment oil needle; 33 the main needle sleeve; 34 the recess of the main needle sleeve; 35 the anti-loosing spring; 36 the fixed plate; 37 the torsion spring; 38 a first inner hole; 39 the mounting hole for the main nozzle; 40 the light bar portion of main needle sleeve; 41 the threaded portion of the idle adjustment oil needle having eccentric hole; 42 a second inner hole; 43 a second light bar portion of the seal sleeve; 44 the handle; 45 the head; 46 the concentric counterbore; 47 a third eccentric convex platform; 48 a first eccentric convex platform; 49 the high speed adjustment oil needle having an eccentric convex platform; 50 a first light bar portion of the seal sleeve; 51 the head of the high speed adjustment oil needle having an eccentric convex platform; 52 the idle speed adjustment oil needle having an eccentric convex platform; 53 a second eccentric convex platform; 54 the head of the idle speed adjustment oil needle having an eccentric convex platform; 55 the threaded portion of the idle speed adjustment oil needle having an eccentric convex platform; 56 the concentric blind hole; 57 the eccentric counterbore; 58 the pump cover; 59 the external threaded portion of the main needle sleeve.

DETAILED DESCRIPTION OF THE INVENTION

In order to understand the invention better and clearly, a detailed description with examples is provided. But, the present invention will be apparent with various changes and modifications without exceeding the broader spirit and scope of the invention as defined by the claims. However, the following examples are just used to explain, and not limit the invention.

Example 1

As shown in FIGS. 1-16, an anti-adjusting rotary valve type carburetor, comprising a body 1, the body 1 is provided with a high speed adjustment oil needle mounting hole and a rotary valve hole 24, a rotary valve 23 is installed inside the rotary valve hole 24, a main needle sleeve 33 is installed on the top of the rotary valve 23, the main needle sleeve 33 is provided with an idle adjustment oil needle mounting hole, a high speed adjustment oil needle having eccentric hole 14 is installed inside the high speed adjustment oil needle mounting hole of the body, the high speed adjustment oil needle having eccentric hole 14 comprising a head of the high speed adjustment oil needle having eccentric hole 7, the end face of the head of the high speed adjustment oil needle 7 is provided with a first eccentric hole 13, the idle adjustment oil needle having eccentric hole 15 is installed inside the idle adjustment oil needle mounting hole, the idle adjustment oil needle having eccentric hole 15 comprising a head of the idle adjustment oil needle having eccentric hole 29, the end face of the head of the idle adjustment oil needle 29 is provided with a second eccentric hole 22, the body 1 is provided with an air intake passage 21, an air and fuel mixing passage 2 and an outlet of the air and fuel mixing passage 20, the front end of the mounting hole for the high speed adjustment oil needle is provided with a recess of the body 3, the front end of the mounting hole for the idle adjustment oil needle is provided with a recess of the main needle sleeve 34, a pump cover 58 is installed on the lower part of the body 1, the fuel pump diaphragm 18 is installed between the fitting surface of the body 1 and the fitting surface of the pump cover 58, the lower end face of the body 1 is provided with a recess, a pressure pulse chamber 16 is formed by a cavity enclosed by the recess and the fuel pump diaphragm 18, the body 1 is also provided with a pressure pulse passage 19, the pressure pulse passage 19 is communicated with the pressure pulse chamber 16, the mounting hole for the high speed adjustment oil needle extends from recess of the body 3 toward inside of the body 1 and it is also successively provided with a first internal thread of the body 30, a seal sleeve mounting hole for the high speed adjustment oil needle 31, a oil passage cavity for the high speed adjustment oil needle 32 and a outlet of the oil passage hole for the high speed adjustment oil needle 5, the body 1 is provided with a fuel inlet 4, the fuel inlet 4 is communicated with the outlet of the oil passage hole for the high speed adjustment oil needle 5, the high speed adjustment oil needle having eccentric hole 14 extends from the side of the head of the high speed adjustment oil needle having eccentric hole 7 and it is also successively provided with locking portion of the high speed adjustment oil needle 8, threaded portion of the high speed adjustment oil needle 9, a first light bar portion of the high speed adjustment oil needle 10 and tip portion of the high speed adjustment oil needle 12, the shape of the tip portion of the high speed adjustment oil needle 12 is conical, a seal sleeve for the high speed adjustment oil needle 11 is installed inside the seal sleeve mounting hole for the high speed adjustment oil needle 31, the seal sleeve for the high speed adjustment oil needle 11 is provided with a first light bar portion of the seal sleeve 50 and a first inner hole 38, the main needle sleeve 33 is provided inside with internal threaded portion of the main needle sleeve 17 and light bar portion of the main needle sleeve 40, an anti-loosing seal sleeve for the idle adjustment oil needle 26 is installed inside the light bar portion of main needle sleeve 40, the anti-loosing seal sleeve for the idle adjustment oil needle 26 is provided with a second light bar portion of the seal sleeve 43 and a second inner hole 42, the head of the idle adjustment oil needle having eccentric hole 29 is provided with threaded portion of the idle adjustment oil needle having eccentric hole 41, the head of the idle adjustment oil needle having eccentric hole 29 that is relative to a second eccentric hole 22 is provided with the concentric blind hole.

Figure 17:
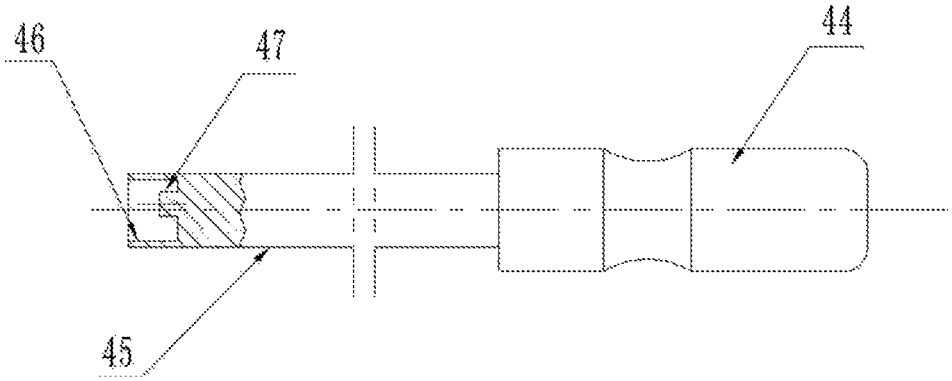
FIG. 17 is a front view of a specialized adjustment tool for the high speed adjustment oil needle having an eccentric hole and the idle adjustment oil needle having an eccentric hole of the embodiment of FIG. 1 in accordance with the present invention.
Figure 18:
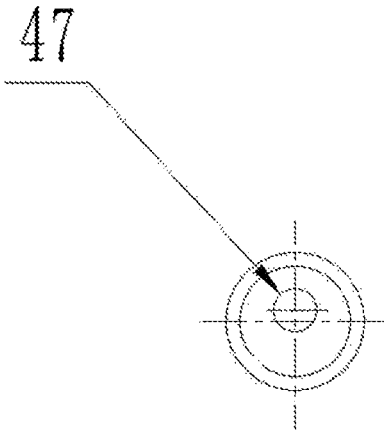
FIG. 18 is a left view of a specialized adjustment tool for the high speed adjustment oil needle having an eccentric hole and the idle adjustment oil needle having an eccentric hole of the embodiment of FIG. 1 in accordance with the present invention.
Figure 19:
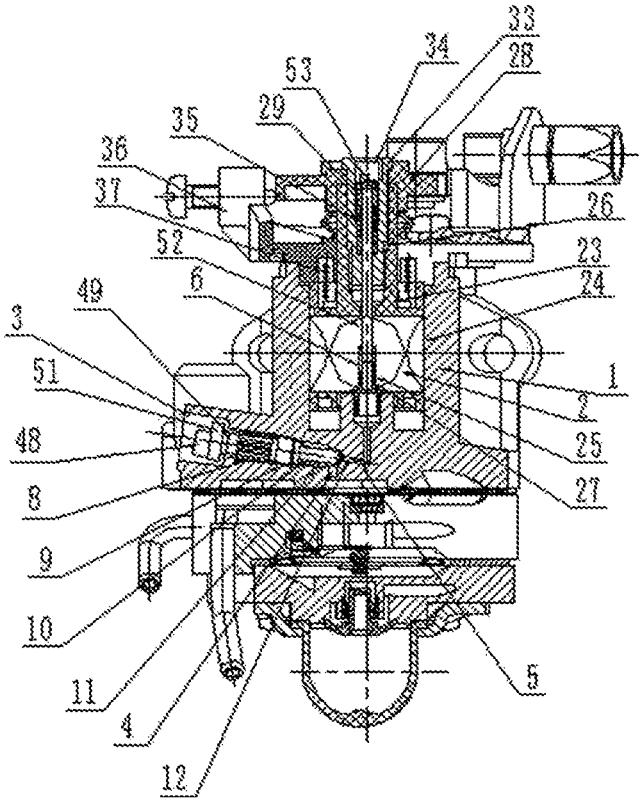
FIG. 19 is a B-B section view of an optimal embodiment in accordance with the present invention, the adjustment oil needle is a high speed adjustment oil needle with an eccentric convex platform and an idle adjustment oil needle with an eccentric convex platform.
Figure 20:
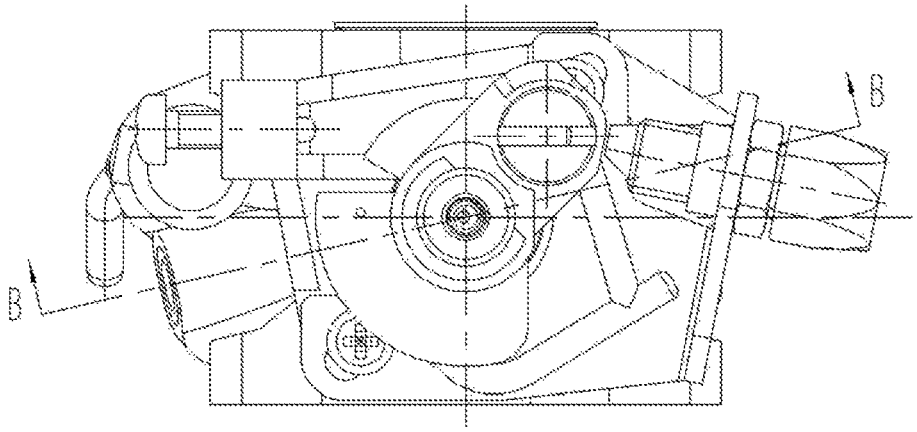
FIG. 20 is a plan view of the embodiment of FIG. 19 in accordance with the invention.
Figure 21:
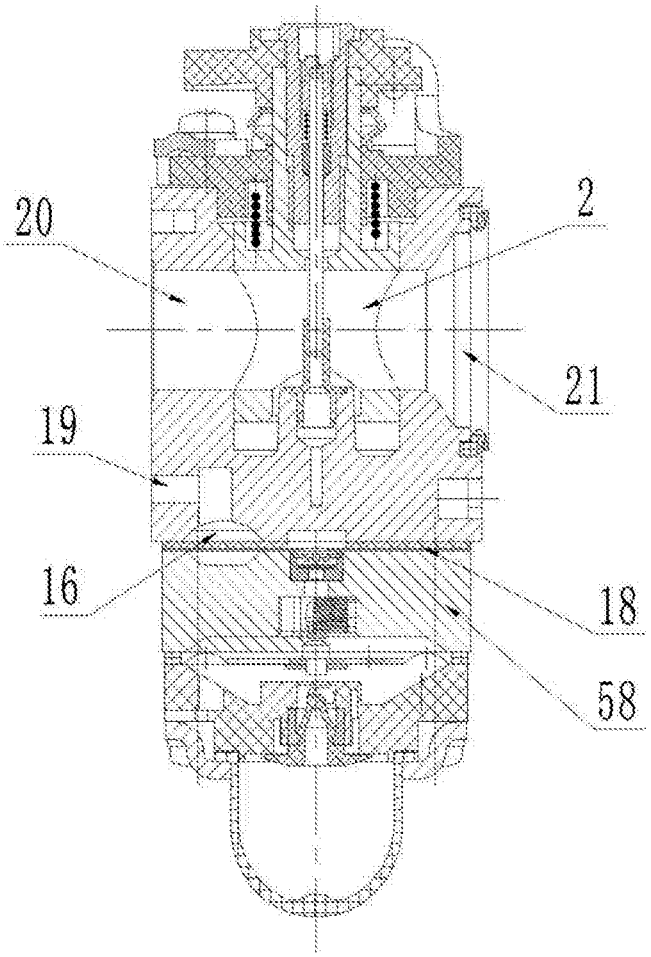
FIG. 21 is a section view of the embodiment of FIG. 19 in accordance with the invention and having a rotary valve shown in its wide-open position.
Figure 22:
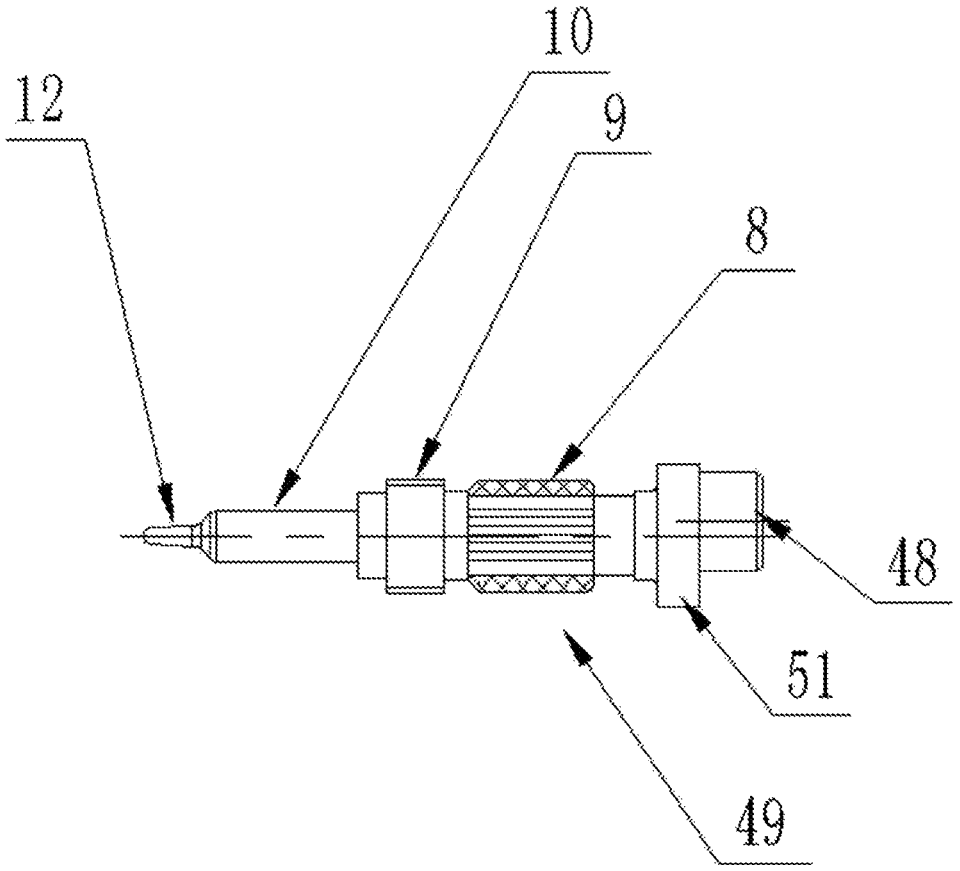
FIG. 22 is a main section view of the high speed adjustment oil needle having an eccentric convex platform of the embodiment of FIG. 19 in accordance with the present invention.
Figure 23:
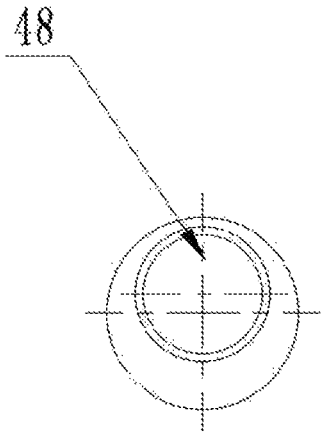
FIG. 23 is a right view of the high speed adjustment oil needle having an eccentric convex platform of the embodiment of FIG. 19 in accordance with the present invention.
Figure 24:
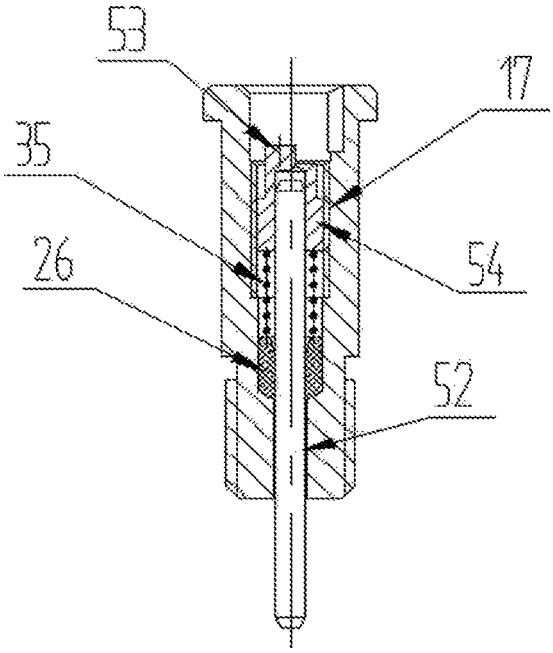
FIG. 24 is an assembly structure main section view of idle adjustment oil needle having an eccentric convex platform and main needle sleeve of the embodiment of FIG. 19 in accordance with the present invention.
Figure 25:
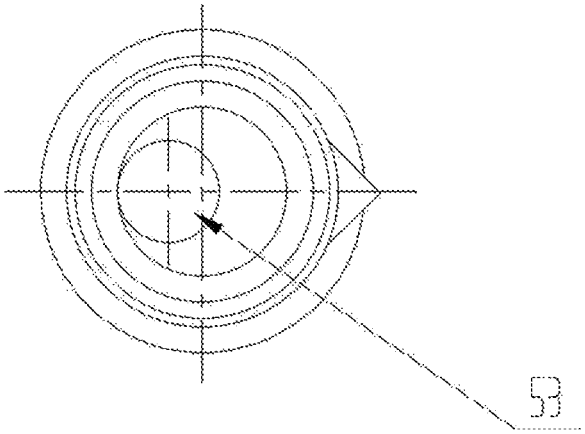
FIG. 25 is a plan view of an idle adjustment oil needle having an eccentric convex platform and a main needle sleeve of the embodiment of FIG. 19 in accordance with the present invention.
Figure 26:
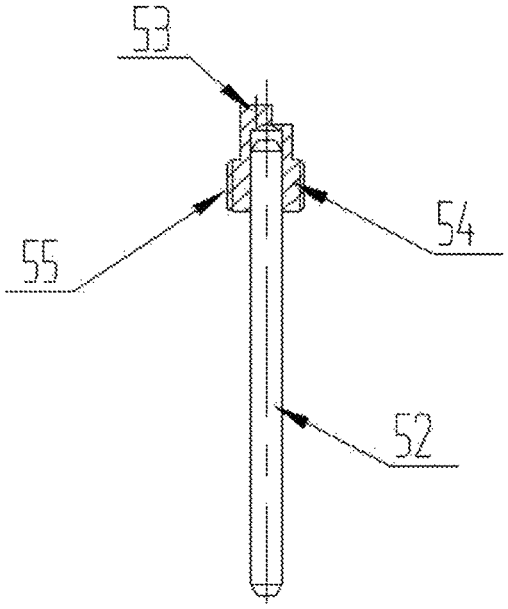
FIG. 26 is an assembly structure main section view of an idle adjustment oil needle having an eccentric convex platform and an adjusting needle head portion of the embodiment of FIG. 19 in accordance with the present invention.
Figure 27:
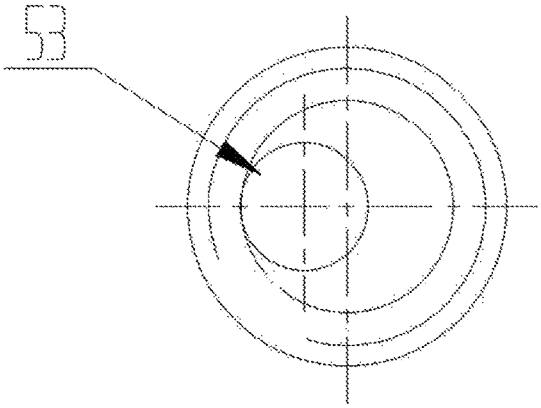
FIG. 27 is an assembly structure plan view of an idle adjustment oil needle having an eccentric convex platform and an adjusting needle head portion of the embodiment of FIG. 19 in accordance with the present invention.

As shown in FIGS. 17 and 18, a specialized adjustment tool having an eccentric convex platform, comprising a handle 44 and a head 45, the front face of the head 45 is provided with the concentric counterbore 46, the bottom surface of the concentric counterbore 46 is provided with a third eccentric convex platform 47.

As shown in FIG. 1, the main nozzle 25 is riveted with the body 1, the main nozzle 25 is also provided with the outlet for oil 6, the light bar of the idle adjustment needle valve is installed in the inside hole of the main nozzle 25, the rotary plate 28, the fixed plate 36 and the torsion spring 37 are installed between the rotary valve 23 and the main needle sleeve 33 that is on the top of the rotary valve 23, the idle adjustment oil needle having eccentric hole 15, the anti-loosing spring 35 and the anti-loosing seal sleeve for the idle adjustment oil needle 26 are installed inside the main needle sleeve 33.

Figure 4:
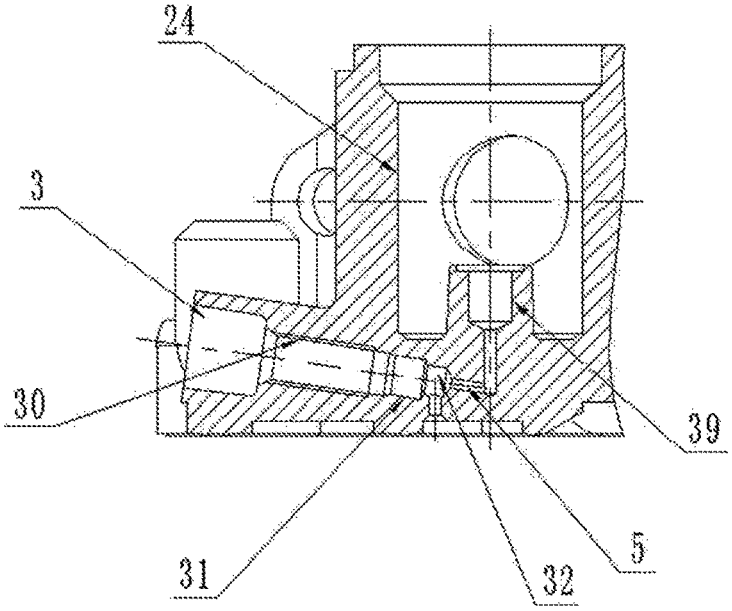
FIG. 4 is a part section view of an installation passage for a high speed adjustment oil needle of the embodiment of FIG. 1 in accordance with the present invention.

As shown in FIG. 4, the body 1 is also provided with the the mounting hole for the main nozzle 39.

Figure 5:
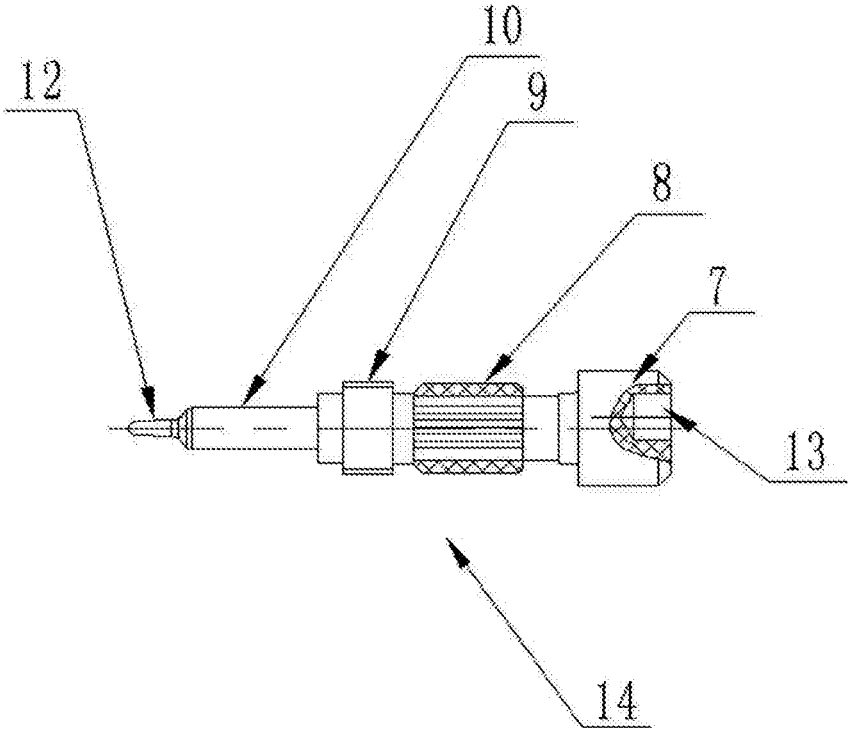
FIG. 5 is a main section view of the high speed adjustment oil needle having an eccentric hole of the embodiment of FIG. 1 in accordance with the present invention.
Figure 6:
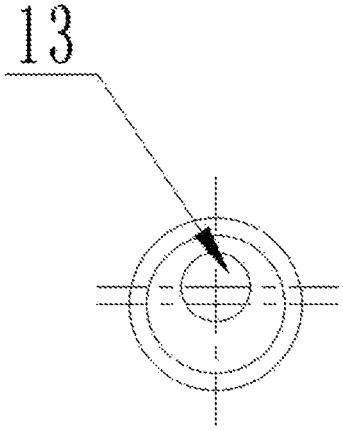
FIG. 6 is a right view of the high speed adjustment oil needle having an eccentric hole of the embodiment of FIG. 1 in accordance with the present invention.

As shown in FIGS. 5 and 6, the tip portion of the high speed adjustment oil needle 12 is matched with the the outlet of the oil passage hole for the high speed adjustment oil needle 5, which is for adjusting the oil output of the carburetor, the threaded portion of the high speed adjustment oil needle 9 is connected with a first internal threaded portion of the body 30 by the screw, the locking portion of the high speed adjustment oil needle 8 is interference fitted with a first internal threaded portion of the body 30, to prevent the engine from changing the position of the oil needle in the work and to affect the performance of the engine.

Figure 7:
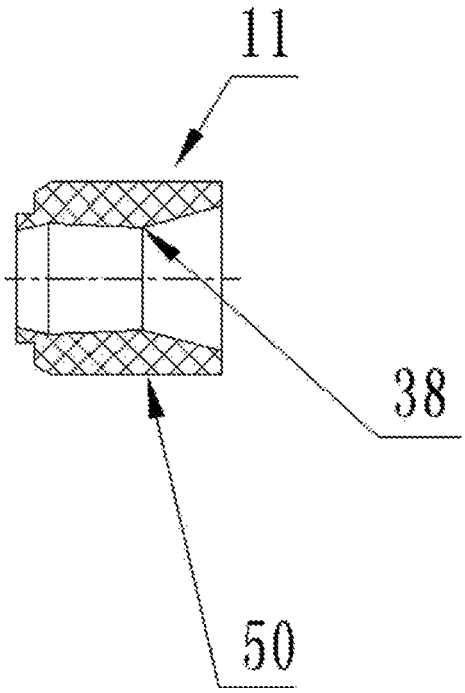
FIG. 7 is a main section view of a seal sleeve of the high speed adjustment oil needle of the embodiment of FIG. 1 in accordance with the present invention.
Figure 8:
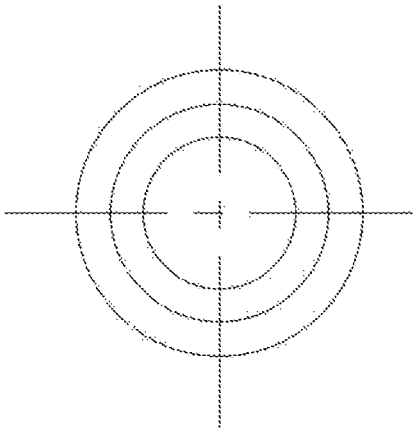
FIG. 8 is a right view of a seal sleeve of the high speed adjustment oil needle of the embodiment of FIG. 1 in accordance with the present invention.

As shown in FIGS. 7 and 8, a first inner hole 38 is tightly fit connected with a first light bar portion of the high speed adjustment oil needle 10 in order to seal and prevent loosing for the high speed adjustment oil needle having eccentric hole 14.

Figure 9:
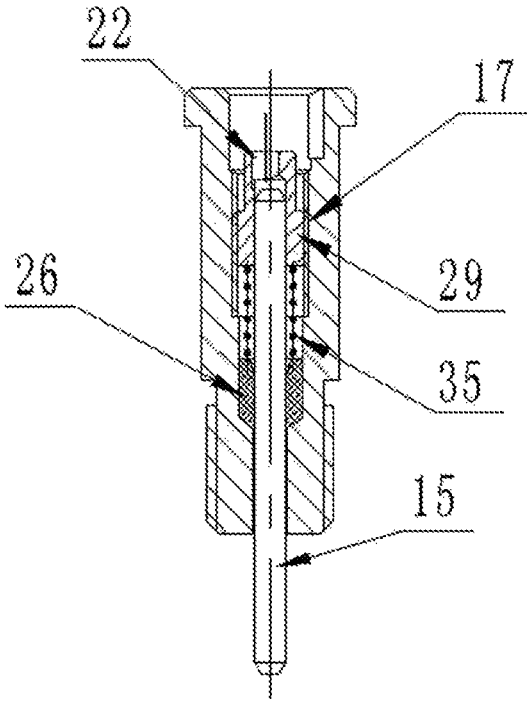
FIG. 9 is an assembly structure main section view of an idle adjustment oil needle having an eccentric hole and a main needle sleeve of the embodiment of FIG. 1 in accordance with the present invention.
Figure 10:
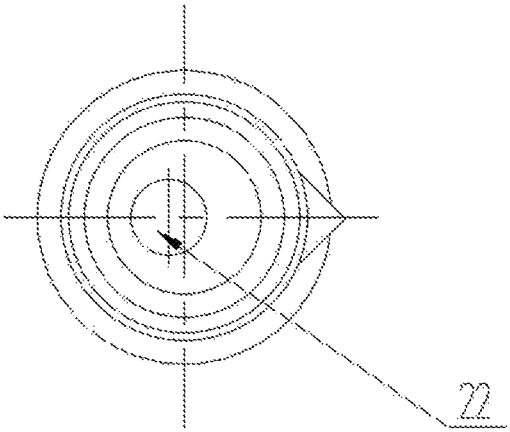
FIG. 10 is an assembly structure plan view of an idle adjustment oil needle having an eccentric hole and a main needle sleeve of the embodiment of FIG. 1 in accordance with the present invention.

As shown in FIGS. 9 and 10, the high speed adjustment oil needle having eccentric hole 14 is through the anti-loosing seal sleeve for the idle adjustment oil needle 26, the threaded portion of the idle adjustment oil needle having eccentric hole 41 is connected with the internal threaded portion of the main needle sleeve 17 by a screw.

Figure 11:
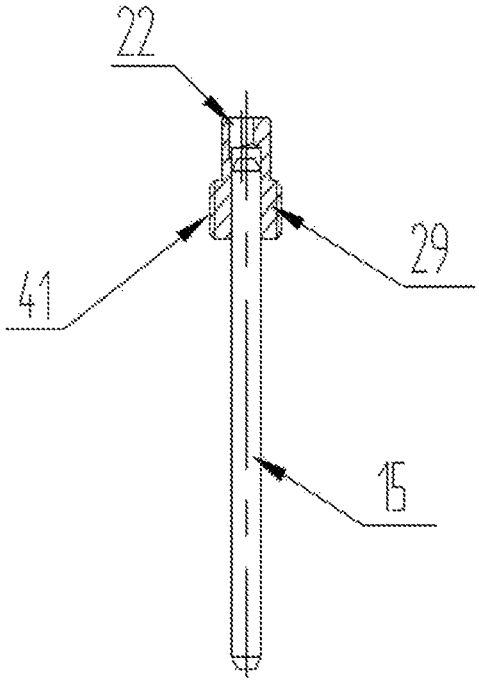
FIG. 11 is an assembly structure main section view of an idle adjustment oil needle having an eccentric hole and an adjusting needle head portion of the embodiment of FIG. 1 in accordance with the present invention.
Figure 12:
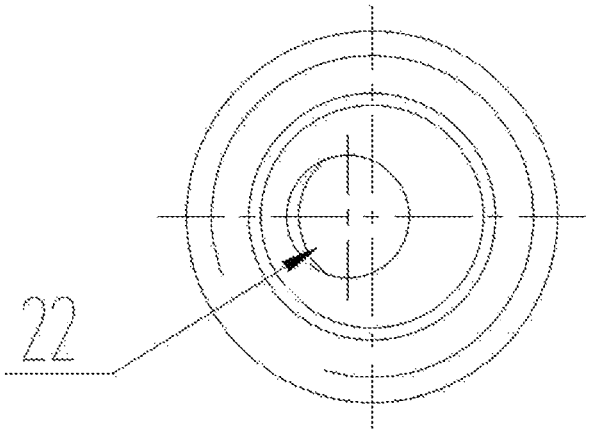
FIG. 12 is an assembly structure plan view of an idle adjustment oil needle having an eccentric hole and an adjusting needle head portion of the embodiment of FIG. 1 in accordance with the present invention.

As shown in FIGS. 11 and 12, the head of the idle adjustment oil needle having eccentric hole 29 is connected with the idle adjustment oil needle having eccentric hole 15 by interference fit riveting.

Figure 13:
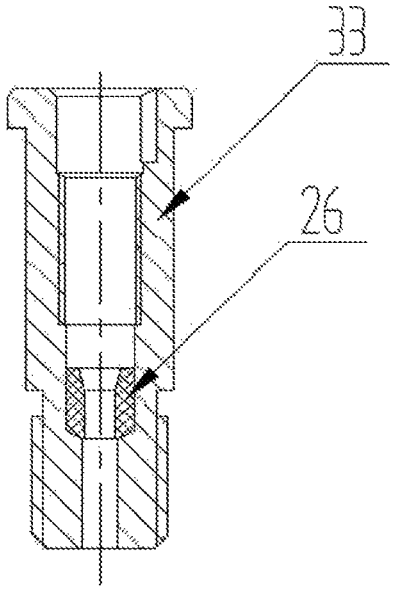
FIG. 13 is an assembly structure main section view of a main needle sleeve and a seal sleeve of the embodiment of FIG. 1 in accordance with the present invention.

As shown in FIG. 13, the anti-loosing seal sleeve for the idle adjustment oil needle 26 is press fitted in the main needle sleeve 33, a second light bar portion of the seal sleeve 43 of the anti-loosing seal sleeve for the idle speed adjustment oil needle 26 is interference fitted with the light bar portion of main needle sleeve 40 of the main needle sleeve 33.

Figure 14:
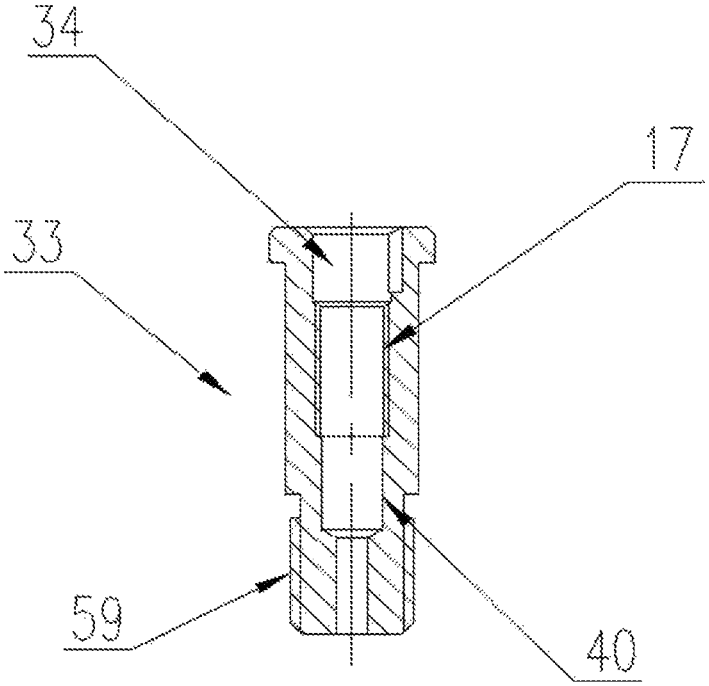
FIG. 14 is a section view of the main needle sleeve of the embodiment of FIG. 1 in accordance with the present invention.
Figure 15:
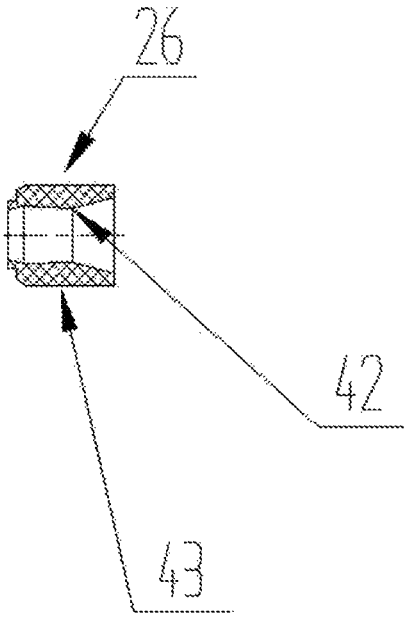
FIG. 15 is a main section view of a seal sleeve of the idle adjustment oil needle having an eccentric hole of the embodiment of FIG. 1 in accordance with the present invention.
Figure 16:
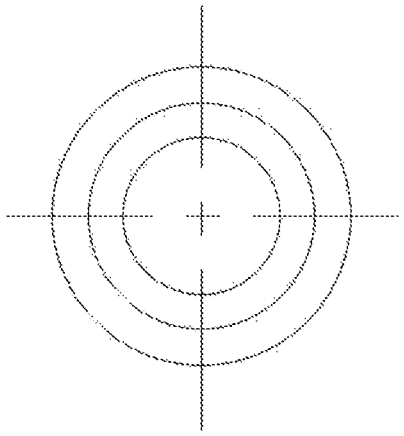
FIG. 16 is a right view of a seal sleeve of the idle adjustment oil needle having an eccentric hole of the embodiment of FIG. 1 in accordance with the present invention.

As shown in FIG. 14, the main needle sleeve 33 is provided with the external threaded portion of the main needle sleeve 59, the light bar portion of main needle sleeve 40, the internal threaded portion of the main needle sleeve 17 and the recess of the main needle sleeve 34.

As shown in FIGS. 17 and 18, a third eccentric convex platform 47 is matching connected with a first eccentric hole 13 or a second eccentric hole 22, for adjusting the high speed adjustment oil needle having eccentric hole 14 or the idle adjustment oil needle having eccentric hole 15.

Example 2

As shown in FIGS. 19-27, an anti-adjusting rotary valve type carburetor that is similar to that in Example 1, and the differences are: comprising body 1, the body 1 is provided with a high speed adjustment oil needle mounting hole and a rotary valve hole 24, a rotary valve 23 is installed inside the rotary valve hole 24, a main needle sleeve 33 is installed on the top of the rotary valve 23, the main needle sleeve 33 is provided with an idle adjustment oil needle mounting hole, a high speed adjustment oil needle having eccentric convex platform 49 is installed inside the high speed adjustment oil needle mounting hole of the body, the high speed adjustment oil needle having eccentric convex platform 49 comprising a head of the high speed adjustment oil needle having eccentric convex platform 51, the head of the high speed adjustment oil needle 51 is provided with a first eccentric convex platform 48, the idle adjustment oil needle having eccentric convex platform 52 is installed inside the idle adjustment oil needle mounting hole, the idle adjustment oil needle having eccentric convex platform 52 comprising a head of the idle adjustment oil needle 54, the head of the idle adjustment oil needle 54 is provided with a second eccentric convex platform 53, the high speed adjustment oil needle having eccentric convex platform 49 extends from the side of the head of the high speed adjustment oil needle having eccentric convex platform 51 and it is also successively provided with locking portion of the high speed adjustment oil needle 8, threaded portion of the high speed adjustment oil needle 9, a first light bar portion of the high speed adjustment oil needle 10 and tip portion of the high speed adjustment oil needle 12.

Figure 28:
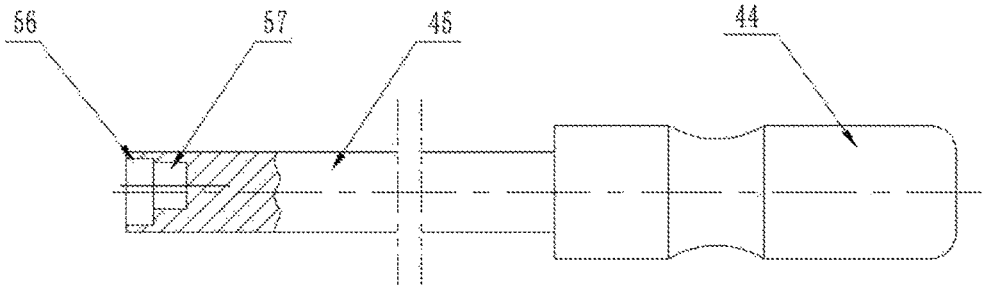
FIG. 28 is a front view of a specialized adjustment tool for the high speed adjustment oil needle having an eccentric convex platform and the idle adjustment oil needle having an eccentric convex platform of the embodiment of FIG. 19 in accordance with the present invention.
Figure 29:
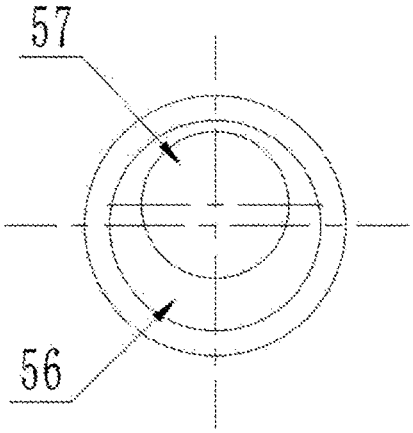
FIG. 29 is a left view of a specialized adjustment tool for the high speed adjustment oil needle having an eccentric convex platform and the idle adjustment oil needle having an eccentric convex platform of the embodiment of FIG. 19 in accordance with the present invention.

As shown in FIGS. 28 and 29, a specialized adjustment tool having an eccentric hole, comprising a handle 44 and a head 45, the front face of the head 45 is provided with the concentric blind hole 56, the bottom surface of the concentric blind hole 56 is provided with an eccentric counterbore 57, the head 45 is provided with light bar portion.

The invention claimed is:

1. An anti-adjusting rotary valve type carburetor, comprising a body, the body is provided with a high speed adjustment needle mounting hole, wherein a high speed adjustment needle having an eccentric hole is installed inside the high speed adjustment needle mounting hole of the body, the high speed adjustment needle having the eccentric hole comprising a head of the high speed adjustment needle having the eccentric hole, an end face of the head of the high speed adjustment needle is provided with a first eccentric hole.

2. The anti-adjusting rotary valve type carburetor of claim 1, wherein the high speed adjustment needle having an eccentric hole extends from a side of the head of the high speed adjustment needle having the eccentric hole and it is also successively provided with a locking portion of the high speed adjustment needle, a threaded portion of the high speed adjustment needle, a first light bar portion of the high speed adjustment needle and a tip portion of the high speed adjustment needle.

3. The anti-adjusting rotary valve type carburetor of claim 2, wherein a shape of the tip portion of the high speed adjustment needle is conical.

4. The anti-adjusting rotary valve type carburetor of claim 1, wherein a head of an idle adjustment needle having an eccentric hole is provided with a threaded portion of the idle adjustment needle having the eccentric hole.

5. The anti-adjusting rotary valve type carburetor of claim 1, wherein a head of an idle adjustment needle having an eccentric hole that is relative to a second eccentric hole is provided with a concentric blind hole.

6. An anti-adjusting rotary valve type carburetor, comprising a body, the body is provided with a rotary valve hole, a rotary valve is installed inside the rotary valve hole, a main needle sleeve is installed on the top of the rotary valve, the main needle sleeve is provided with an idle adjustment needle mounting hole, wherein an idle adjustment needle having an eccentric hole is installed inside the idle adjustment needle mounting hole of the main needle sleeve, the idle adjustment needle having the eccentric hole comprising a head of the idle adjustment needle having the eccentric hole, an end face of the head of the idle adjustment needle is provided with a second eccentric hole.

7. A specialized adjustment tool having an eccentric convex platform for the anti-adjusting rotary valve type carburetor of claim 1 or 6, comprising a handle and a head, wherein a front face of the head is provided with a concentric counterbore, a bottom surface of the concentric counterbore is provided with a third eccentric convex platform.

8. The specialized adjustment tool having the eccentric convex platform of claim 7, wherein the head is provided with a light bar portion.

9. An anti-adjusting rotary valve type carburetor, comprising a body, the body is provided with a high speed adjustment needle mounting hole, wherein a high speed adjustment needle having an eccentric convex platform is installed inside the high speed adjustment needle mounting hole of the body, the high speed adjustment needle having the eccentric convex platform comprising a head of the high speed adjustment needle having the eccentric convex platform, the head of the high speed adjustment needle is provided with a first eccentric convex platform.

10. The anti-adjusting rotary valve type carburetor of claim 1 or 9, wherein a front end of the high speed adjustment needle mounting hole for the high speed adjustment needle is provided with a recess of the body.

11. The anti-adjusting rotary valve type carburetor of claim 10, wherein the high speed adjustment needle mounting hole for the high speed adjustment needle extends from the recess of the body toward inside of the body and it is also successively provided with a first internal thread of the body, a seal sleeve mounting hole for the high speed adjustment needle, a passage cavity for the high speed adjustment needle and an outlet of the passage cavity for the high speed adjustment needle.

12. The anti-adjusting rotary valve type carburetor of claim 11, wherein the body is provided with a fuel inlet, the fuel inlet is communicated with the outlet of the passage cavity for the high speed adjustment needle.

13. The anti-adjusting rotary valve type carburetor of claim 11, wherein a seal sleeve for the high speed adjustment needle is installed inside the seal sleeve mounting hole for the high speed adjustment needle.

14. The anti-adjusting rotary valve type carburetor of claim 13, wherein the seal sleeve for the high speed adjustment needle is provided with a first light bar portion of the seal sleeve and a first inner hole.

15. The anti-adjusting rotary valve type carburetor of claim 9, wherein the high speed adjustment needle having the eccentric convex platform extends from a side of the head of the high speed adjustment needle having the eccentric convex platform and it is also successively provided with a locking portion of the high speed adjustment needle, a threaded portion of the high speed adjustment needle, a first light bar portion of the high speed adjustment needle, and a tip portion of the high speed adjustment needle.

16. The anti-adjusting rotary valve type carburetor of claim 15, wherein a shape of the tip portion of the high speed adjustment needle is conical.

17. An anti-adjusting rotary valve type carburetor, comprising a body, the body is provided with a rotary valve hole, a rotary valve is installed inside the rotary valve hole, a main needle sleeve is installed on a top of the rotary valve, the main needle sleeve is provided with an idle adjustment needle mounting hole, wherein an idle adjustment needle having an eccentric convex platform is installed inside the idle adjustment needle mounting hole of the main needle sleeve, the idle adjustment needle having the eccentric convex platform comprising a head of the idle adjustment needle, the head of the idle adjustment needle is provided with a second eccentric convex platform.

18. A specialized adjustment tool having an eccentric hole for the anti-adjusting rotary valve type carburetor of claim 9 or 17, comprising a handle and a head, wherein a front face of the head is provided with a concentric blind hole, a bottom surface of the concentric blind hole is provided with an eccentric counterbore.

19. The anti-adjusting rotary valve type carburetor of claim 1 or 6 or 9 or 17, wherein the body is provided with an air intake passage, an air and fuel mixing passage and an outlet of the air and fuel mixing passage.

20. The anti-adjusting rotary valve type carburetor of claim 6 or 17, wherein the front end of the high speed adjustment needle mounting hole for the idle adjustment needle is provided with a recess of the main needle sleeve.

21. The anti-adjusting rotary valve type carburetor of claim 1 or 6 or 9 or 17, wherein a pump cover is installed on a lower part of the body, a fuel pump diaphragm is installed between a fitting surface of the body and a fitting surface of the pump cover.

22. The anti-adjusting rotary valve type carburetor of claim 21, wherein a lower end face of the body is provided with a recess, a pressure pulse chamber is formed by a cavity enclosed by the recess and the fuel pump diaphragm, the body is also provided with a pressure pulse passage, the pressure pulse passage is communicated with the pressure pulse chamber.

23. The anti-adjusting rotary valve type carburetor of claim 6 or 17, wherein the main needle sleeve is provided inside with an internal threaded portion of the main needle sleeve and a light bar portion of the main needle sleeve, an anti-loosing seal sleeve for the idle adjustment needle is installed inside the light bar portion of the main needle sleeve.

24. The anti-adjusting rotary valve type carburetor of claim 23, wherein the anti-loosing seal sleeve for the idle adjustment needle is provided with a second light bar portion of the anti-loosing seal sleeve and a second inner hole.

25. The specialized adjustment tool having the eccentric hole of claim 18, wherein the head is provided with a light bar portion.

* * * * *